US007939799B2

(12) United States Patent
Kim et al.

(10) Patent No.: US 7,939,799 B2
(45) Date of Patent: May 10, 2011

(54) TANDEM FOURIER TRANSFORM ION CYCLOTRON RESONANCE MASS SPECTROMETER

(75) Inventors: Hyun Sik Kim, Daejeon (KR); Myoung Choul Choi, Seoul (KR); Jong Shin Yoo, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 453 days.

(21) Appl. No.: 12/278,768

(22) PCT Filed: Sep. 12, 2006

(86) PCT No.: PCT/KR2006/003618

§ 371 (c)(1),
(2), (4) Date: Aug. 7, 2008

(87) PCT Pub. No.: WO2007/091754

PCT Pub. Date: Aug. 16, 2007

(65) Prior Publication Data

US 2009/0008549 A1 Jan. 8, 2009

(30) Foreign Application Priority Data

Feb. 7, 2006 (KR) ..... 10-2006-0011650

(51) Int. Cl.
*H01J 49/00* (2006.01)

(52) U.S. Cl. ..... 250/291; 250/281; 250/288

(58) Field of Classification Search ..... None
See application file for complete search history.

(56) References Cited

U.S. PATENT DOCUMENTS

| | | | | |
|---|---|---|---|---|
| 4,283,626 | A | 8/1981 | Siegel | |
| 4,535,235 | A * | 8/1985 | McIver, Jr. | 250/282 |
| 5,854,485 | A | 12/1998 | Bergmann | |
| 6,504,148 | B1 | 1/2003 | Hager | |
| 6,770,871 | B1 * | 8/2004 | Wang et al. | 250/281 |
| 7,255,992 | B2 * | 8/2007 | Ecker et al. | 435/6 |
| 7,329,864 | B2 * | 2/2008 | Wang | 250/288 |
| 2005/0178963 | A1 * | 8/2005 | Londry et al. | 250/293 |
| 2006/0289741 | A1 * | 12/2006 | Li | 250/288 |
| 2007/0057172 | A1 * | 3/2007 | Wang | 250/281 |

* cited by examiner

*Primary Examiner* — Bernard E Souw
*Assistant Examiner* — Andrew Smyth
(74) *Attorney, Agent, or Firm* — Rabin & Berdo, PC

(57) ABSTRACT

A tandem Fourier transform ion cyclotron resonance mass spectrometer is provided. In the mass spectrometer, the ions selected by a FT-ICR mass analyzer, which can perform an ion selection process and a mass measurement process with a time interval between the processes, are transmitted through an ion guide to a collision cell, which is located a predetermined distance from the FT-ICR mass analyzer, to split into fragment ions. The fragment ions are transmitted to the FT-ICR mass analyzer that measures the mass of the fragment ions. The fragment ions are generated in the collision cell 60 established separately from the FT-ICR mass analyzer 40 according to the mass spectrometer. Accordingly, It can solve various problems (e.g., the radius reduction of cyclotron motion of colliding ions, or the removal of periphery gas after generating the fragment ions) occurred in a tandem mass spectrometer using a conventional tandem-in-time mass analysis method. Also, a high resolution and with sensitivity measurement can be achieved. Moreover, when a reagent gas instead of a collision gas in the collision cell is injected, the gas phase reaction of the selected ions and the reagent gas can be observed, and the mass of the ions generated in the gas phase reaction can be measured.

10 Claims, 2 Drawing Sheets

[Fig. 1]
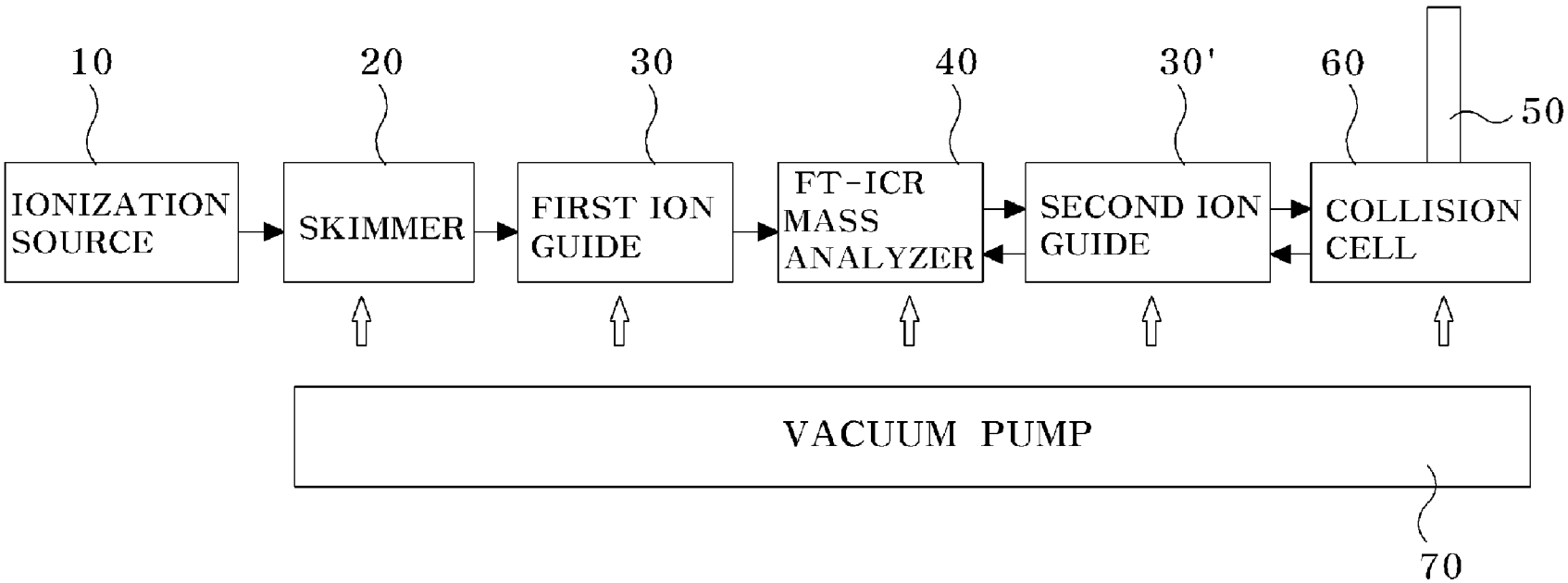

[Fig. 2]
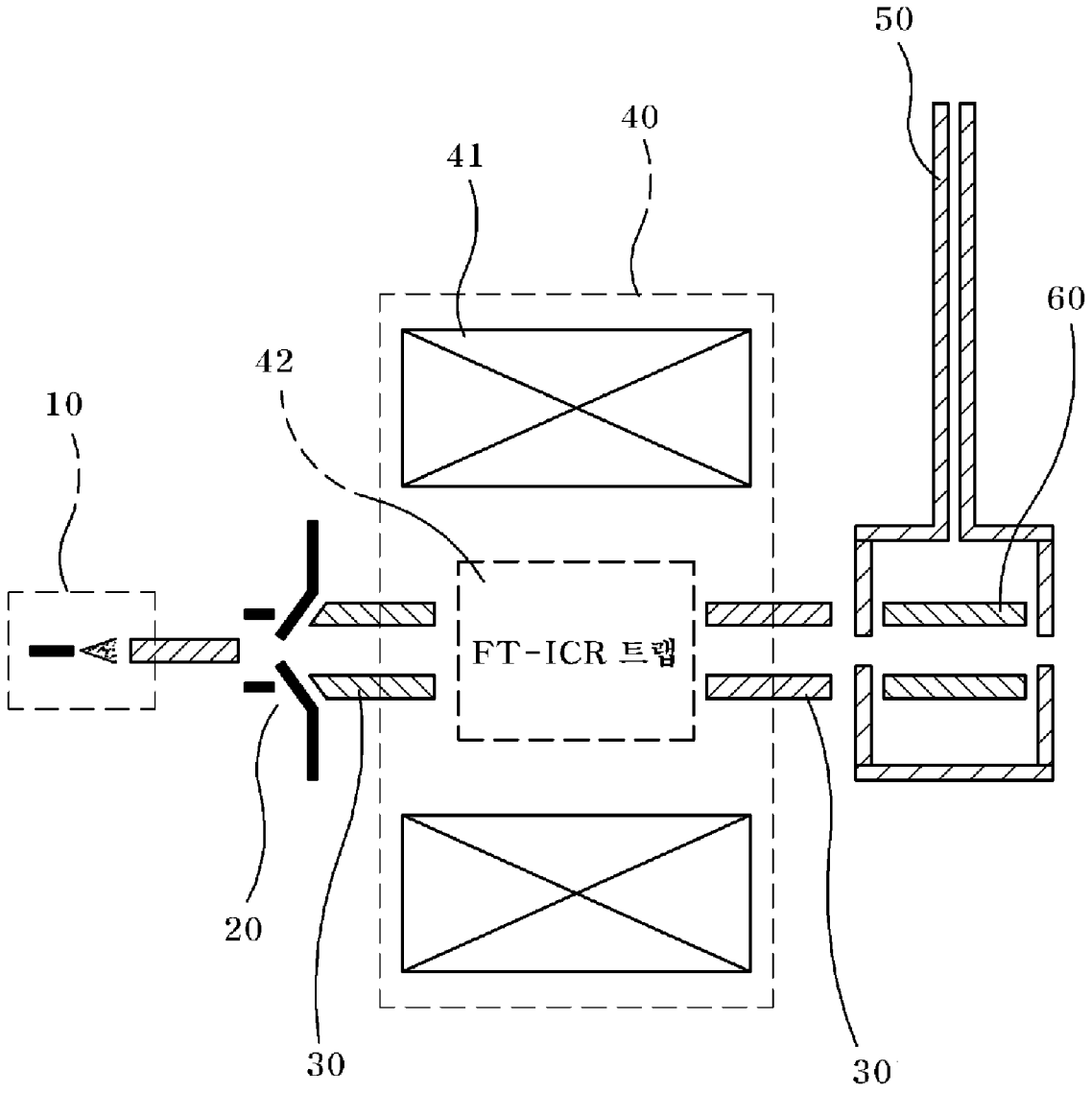

TANDEM FOURIER TRANSFORM ION CYCLOTRON RESONANCE MASS SPECTROMETER

TECHNICAL FIELD

The present invention relates to a mass spectrometer, and more particularly, to a tandem Fourier transform ion cyclotron resonance mass spectrometer.

BACKGROUND ART

A mass spectrometer is an apparatus for detecting the molecular structure of a test sample by selecting molecular ions formed by an ionization source and measuring the mass of the fragment ions with a mass analyzer, wherein the ionization source ionizes the test sample using electrospray ionization (ESI) and matrix assists laser desorption ionization (MALDI) methods, and the mass analyzer includes an ion trap analyzer, time-of-flight analyzer, quadrupole analyzer and Fourier transform ion cyclotron resonance (FT-ICR) analyzer.

A tandem mass spectrometer uses a combination of one or more different types of the various mass analyzers, and is classified into a tandem mass spectrometer using a tandem-in-space mass analysis method and a tandem mass spectrometer using a tandem-in-time mass analysis method.

The tandem mass spectrometer using the tandem-in-space mass analysis method generally uses the quadrupole analyzer and the ion trap analyzer. One of two mass analyzers spaced apart from each other selects and separates ions that will be measured, and then transmits the separated ions to a collision cell having a collision gas. The other of the two separate mass analyzers measures the mass of fragment ions transmitted from the collision cell, wherein the fragment ions are generated by colliding the separated ions with the collision gas.

The tandem mass spectrometer using the tandem-in-time mass analysis method uses a trap type mass analyzer such as a FT-ICR analyzer, and performs an ion selection process and a mass measurement process with a time interval in the same mass analyzer.

The tandem mass spectrometer using the tandem-in-space mass analysis method generally has a low resolution in selecting the ions with a specific mass, thus having a limitation in selecting and separating the ions of the specific mass with high resolution. The resolution is calculated by dividing the width at half height of a peak in a mass spectrum by the value of m/z (mass-to-charge ratio) at the peak.

The tandem mass spectrometer using the tandem-in-time mass analysis method can select the ions with a specific mass at high resolution in a FT-ICR trap using a FT-ICR analyzer. In this case, an inert collision gas is injected into the FT-ICR trap for generating fragment ions, the fragment ions are generated by colliding the inert collision gas with the ions selected by the FT-ICR mass analyzer, and the masses of the generated fragment ions are measured in the FT-ICR trap.

However, in the tandem mass spectrometer using the tandem-in-time mass analysis method, the radius of ion cyclotron motion is reduced because the peripheral pressure in the FT-ICR trap is increased by injecting the inert collision gas. Accordingly, the magnitude of ion detection signal is gradually decreased and the resolution and the magnitude of a mass spectrum are reduced.

Also, the peripheral gas in the FT-ICR trap must be removed after generating the fragment ions and thus the mass of the fragment ions cannot be measured quickly.

DISCLOSURE OF INVENTION

Technical Problem

Accordingly, the present invention is directed to a tandem Fourier transform ion cyclotron resonance mass spectrometer that substantially obviates one or more of the problems due to limitations and disadvantages of the related art.

An object of the present invention is to provide a tandem Fourier transform ion cyclotron resonance mass spectrometer transmitting the ions selected by a FT-ICR mass analyzer, which can perform an ion selection process and a mass measurement process with a time interval between the processes, through an ion guide to a collision cell, which is located at a predetermined distance from the FT-ICR mass analyzer, to split into fragment ions. The fragment ions are transmitted to the FT-ICR mass analyzer that measures the mass of the fragment ions.

Technical Solution

To achieve these and other advantages and in accordance with the purpose of the present invention, as embodied and broadly described, there is provided a tandem Fourier transform ion cyclotron resonance mass spectrometer including: an ionization source for ionizing a sample injected in a gaseous state or the like and ejecting ions, a skimmer for maintaining a vacuum state for the ions ejected from the ionization source, a first ion guide for transmitting the ions inflowed through the skimmer, a FT-ICR mass analyzer for selecting the ions with a specific mass among the ions inflowed through the first ion guide, and measuring the mass of fragment ions of the selected ions, a second ion guide for transmitting the ions selected by the FT-ICR mass analyzer, a collision cell for colliding the selected ions inflowed through the second ion guide with a collision gas injected through a collision gas injection port to generate fragment ions and transmitting the fragment ions to the FT-ICR mass analyzer through the second ion guide, and a vacuum pump for maintaining a vacuum state in the interior of the ionization source, the skimmer, the first ion guide, the FT-ICR mass analyzer, the second ion guide, the collision gas injection port and the collision cell.

Advantageous Effects

As described above, a tandem Fourier transform ion cyclotron resonance mass spectrometer according to the present invention can select ions at high resolution by performing an ion selection process in a FT-ICR mass analyzer. Also, the fragment ions are generated in the collision cell established separately from the FT-ICR mass analyzer. This can solve various problems (e.g., the radius reduction of cyclotron motion of colliding ions, or the removal of periphery gas after generating the fragment ions) occurred in a tandem mass spectrometer using a conventional tandem-in-time mass analysis method, thereby achieving the high resolution and high-sensitivity measurement.

Moreover, when a reagent gas instead of a collision gas in the collision cell is injected, the gas phase reaction of the selected ions and the reagent gas can be observed, and the mass of the ions generated in the gas phase reaction can be measured.

BRIEF DESCRIPTION OF THE DRAWINGS

FIG. 1 is a block diagram of a tandem Fourier transform ion cyclotron resonance mass spectrometer; and FIG. 2 is a schematic sectional view of a tandem Fourier transform ion cyclotron resonance mass spectrometer.

DESCRIPTION OF SYMBOLS IN MAIN PARTS OF THE DRAWINGS

10: ionization source
20: skimmer
30: first ion guide
40: FT-ICR mass analyzer
41: cylindrical superconducting magnet
42: FT-ICR trap
50: collision gas injection port
60: collision cell
70: vacuum pump

BEST MODE FOR CARRYING OUT THE INVENTION

Hereinafter, preferred embodiments of the present invention will be described in detail with reference to accompanying drawings.

Referring to FIGS. 1 and 2, an ionization source 10 ionizes a sample injected in a gaseous state or the like into molecular ions, and ejects the molecular ions.

A skimmer 20 allows the ions ejected from the ionization source 10 to be transmitted to a first ion guide 30 in a vacuum state.

The first ion guide 30 transmits to a FT-ICR mass analyzer 40 the ions that are ejected from the ionization source 10 and inflowed into the first ion guide 30 through the skimmer 20.

The FT-ICR mass analyzer 40 selects the ions with a specific mass among the ions inflowed through the first ion guide 30, and measures the mass of fragment ions that are generated in a collision cell 60 and inflowed through a second ion guide 30'.

The FT-ICR mass analyzer 40 includes a cylindrical superconducting magnet 41, and an ion selection and mass measurement FT-ICR trap 42 located inside the magnet 41.

The FT-ICR mass analyzer 40 may include the cylindrical superconducting magnet 41, an ion selection FT-ICR trap (not shown), and a mass measurement FT-ICR trap (not shown).

When an ion selection FT-ICR trap and a mass measurement FT-ICR trap are separated in the FT-ICR trap, the mass measurement FT-ICR trap may be lager in volume than the ion selection FT-ICR trap to improve the measurement sensitivity of an ion.

Using an arbitrary waveform generator (AWG), the FT-ICR mass analyzer 40 selects the ions with a specific mass at a high resolution of 5000~100000 by ejecting the ions in a predetermined mass range.

Using a stored waveform inverse Fourier transform (SWIFT) technique, the FT-ICR mass analyzer 40 selects the ions with a specific mass at a resolution of 5000~100000 by increasing the radius of ion cyclotron motion and ejecting undesired ions. The SWIFT technique is summarized as follows: a waveform of frequencies reactive to a desired ion mass range is selected, and a waveform function in time domain is generated using inverse Fourier transform.

The second ion guide 30' transmits the ions selected by the FT-ICR mass analyzer 40 to the collision cell 60.

The collision cell 60 allows the selected ions inflowed through the second guide 30' to collide with a collision gas injected through a collision gas injection port 50. Then, fragment ions are generated. The generated fragment ions are transmitted to the FT-ICR mass analyzer 40 through the second ion guide 30'.

After ions selected by the FT-ICR mass analyzer 40 are inflowed into the collision cell 60 through the second ion guide 30', a specific reagent gas reactive to the selected ions may be injected through the collision gas injection port 50. Then, a gas phase reaction of the selected ions and the reagent gas is carried out. Ions generated in the gas phase reaction may be transmitted to the FT-ICR mass analyzer 40, and the FT-ICR mass analyzer 40 can measure the mass of the ions generated in the gas phase reaction.

A vacuum pump 70 maintains a vacuum state in the interior of the ionization source 10, the skimmer 20, the first ion guide 30, the FT-ICR mass analyzer 40, the second ion guide 30', the collision gas injection port 50 and the collision cell 60.

A description will be given of the operation of the tandem Fourier transform ion cyclotron resonance mass spectrometer including the above components according to the present invention.

A sample is injected into the ionization source 10 in a gaseous state or the like, and then the ionization source 10 ionizes a sample and ejects ions generated by the ionization source 10.

The skimmer 20 allows the ions ejected from the ionization source 10 to be transmitted to the first ion guide 30 in a vacuum state. The ions are transmitted to the FT-ICR trap 42 located inside the cylindrical superconducting magnet 41 of the FT-ICR mass analyzer 40 through the first ion guide 30.

The FT-ICR mass analyzer 40 selects the ions with a specific mass for measurement among the ions inflowed through the first ion guide 30.

Using an AWG, the FT-ICR mass analyzer 40 selects the ions with a specific mass at a high resolution of 5000~100000 by ejecting the ions in a predetermined mass range.

Using a SWIFT technique, the FT-ICR mass analyzer 40 selects the ions with a specific mass at a resolution of 5000~100000 by increasing the radius of ion cyclotron motion and ejecting undesired ions. The SWIFT technique is summarized as follows: a waveform of frequencies reactive to a desired ion mass range is selected, and a waveform function in time domain is generated using inverse Fourier transform.

As described above, when the ions with a specific mass for measurement are selected, the FT-ICR mass analyzer 40 transmits the selected ions to the collision cell 60 via the second ion guide 30'.

The collision cell 60 collides the selected ions inflowed through the second ion guide 30' with a collision gas (e.g., neutral gas such as nitrogen and argon) injected through a collision gas injection port 50 to generate fragment ions. The collision cell 60 transmits the fragment ions to the FT-ICR mass analyzer 40 through the second ion guide 30'.

As described above, fragment ions are generated in the collision cell 60 established separately from the FT-ICR mass analyzer 40 by colliding the ions selected by the FT-ICR mass analyzer 40 with a collision gas. It can solve various problems (e.g., the radius reduction of cyclotron motion of colliding ions, or the removal of periphery gas after generating fragment ions) occurred in a tandem mass spectrometer using a conventional tandem-in-time mass analysis method. Accordingly, high resolution and high sensitivity measurement can be achieved.

When fragment ions generated in the collision cell 60 are inflowed into the FT-ICR mass analyzer 40 through the second ion guide 30', the FT-ICR mass analyzer 40 allows a magnetic field reactive to a resonance frequency to be produced in the FT-ICR trap 42. The fragmented ions have a cyclotron motions in the direction perpendicular to the magnetic field. The masses of various ions can be measured simultaneously and precisely by measuring an image current induced by the fragment ions at electrodes of the FT-ICR trap 42.

In operation of a tandem Fourier transform ion cyclotron resonance mass spectrometer according to the present invention, when the FT-ICR mass analyzer 40 selects the ions with a specific mass for measurement, and transmits the selected ions to the collision cell 60 through the second ion guide 30', a specific reagent gas reactive to the selected ions instead of a collision gas is injected to the collision cell 60, and then a gas phase reaction of the selected ions and the reagent gas (e.g., the interchange reaction of hydrogen with deuterium) can be observed in the interior of the collision cell 60.

Also, the ions generated in the gas phase reaction are transmitted to the FT-ICR mass analyzer 40, and the mass of the generated ions can be measured.

For example, protein ions generated by the interchange reaction of a hydrogen with a deuterium may be transmitted to the FT-ICR mass analyzer 40 to measure the mass of the protein ions. Accordingly, the structural information of a proteins and a protein complex can be obtained.

It will be apparent to those skilled in the art that various modifications and variations can be made in the present invention. Thus, it is intended that the present invention covers the modifications and variations of this invention provided they come within the scope of the appended claims and their equivalents.

The invention claimed is:

1. A tandem Fourier transform ion cyclotron resonance mass spectrometer comprising:

an ionization source for ionizing a sample and ejecting ions;

a skimmer for maintaining a vacuum state for the ions ejected from the ionization source;

a first ion guide for transmitting the ions inflowed through the skimmer;

a FT-ICR mass analyzer for selecting the ions with a specific mass among the ions inflowed through the first ion guide, and measuring the mass of fragment ions of the selected ions;

a second ion guide for transmitting the ions selected by the FT-ICR mass analyzer;

a collision cell for colliding the selected ions inflowed through the second ion guide with a collision gas injected through a collision gas injection port to generate the fragment ions and transmitting the fragment ions to the FT-ICR mass analyzer through the second ion guide; and a vacuum pump for maintaining a vacuum state in the interior of the ionization source, the skimmer, the first ion guide, the FT-ICR mass analyzer, the second ion guide, the collision gas injection port and the collision cell.

2. The apparatus of claim 1, wherein the FT-ICR mass analyzer comprises a cylindrical superconducting magnet and an ion selection and mass measurement FT-ICR trap located inside the cylindrical superconducting magnet.

3. The apparatus of claim 1, wherein the FT-ICR mass analyzer comprises a cylindrical superconducting magnet, an ion selection FT-ICR trap and a mass measurement FT-ICR trap located inside the cylindrical superconducting magnet.

4. The apparatus of claim 3, wherein the FT-ICR mass analyzer uses an AWG (arbitrary waveform generator) to select the ions with a specific mass at a high resolution of 5000~100000 by ejecting the ions in a predetermined mass range.

5. The apparatus of claim 3, wherein the FT-ICR mass analyzer uses a SWIFT (stored waveform inverse Fourier transform) technique to select the ions with a specific mass at a resolution of 5000~100000 by increasing the radius of ion cyclotron motion and ejecting undesired ions, the SWIFT technique being summarized as follows: a waveform of frequencies reactive to a desired ion mass range is selected, and a waveform function in time domain is generated using inverse Fourier transform.

6. The apparatus of claim 1, wherein the collision cell injects a specific reagent gas reactive to the ions selected by the FT-ICR mass analyzer through the collision gas injection port after the selected ions are inflowed into the collision cell through the second ion guide induces the gas phase reaction of the selected ions and the reagent gas, and transmits the ions generated in the gas phase reaction to the FT-ICR mass analyzer to allow the FT-ICR mass analyzer to measure the mass of the ions generated in the gas phase reaction.

7. The apparatus of claim 2, wherein the FT-ICR mass analyzer uses an AWG (arbitrary waveform generator) to select the ions with a specific mass at a high resolution of 5000~100000 by ejecting the ions in a predetermined mass range.

8. The apparatus of claim 1, wherein the FT-ICR mass analyzer uses an AWG (arbitrary waveform generator) to select the ions with a specific mass at a high resolution of 5000~100000 by ejecting the ions in a predetermined mass range.

9. The apparatus of claim 2, wherein the FT-ICR mass analyzer uses a SWIFT (stored waveform inverse Fourier transform) technique to select the ions with a specific mass at a resolution of 5000~100000 by increasing the radius of ion cyclotron motion and ejecting undesired ions, the SWIFT technique being summarized as follows: a waveform of frequencies reactive to a desired ion mass range is selected, and a waveform function in time domain is generated using inverse Fourier transform.

10. The apparatus of claim 1, wherein the FT-ICR mass analyzer uses a SWIFT (stored waveform inverse Fourier transform) technique to select the ions with a specific mass at a resolution of 5000~100000 by increasing the radius of ion cyclotron motion and ejecting undesired ions, the SWIFT technique being summarized as follows: a waveform of frequencies reactive to a desired ion mass range is selected, and a waveform function in time domain is generated using inverse Fourier transform.

* * * * *